US005839017A

United States Patent [19]

Mordenga

[11] Patent Number: 5,839,017

[45] Date of Patent: Nov. 17, 1998

[54] DEVELOPER LEVEL DETECTION SYSTEM

[75] Inventor: Samuel P. Mordenga, Rochester, N.Y.

[73] Assignee: Xerox Corporation, Stamford, Conn.

[21] Appl. No.: 826,956

[22] Filed: Apr. 9, 1997

[51] Int. Cl.[6] ..... G03G 15/08

[52] U.S. Cl. ..... 399/35

[58] Field of Search ..... 399/27, 35

[56] References Cited

U.S. PATENT DOCUMENTS

| | | | |
|---|---|---|---|
| 4,891,673 | 1/1990 | Buell | 399/257 |
| 5,081,491 | 1/1992 | Lux et al. | 355/208 |

FOREIGN PATENT DOCUMENTS

| | | |
|---|---|---|
| 55-143410 | 11/1980 | Japan . |
| 1-173077 | 7/1989 | Japan . |

*Primary Examiner*—Joan H. Pendegrass
*Attorney, Agent, or Firm*—Lloyd F. Bean, II

[57] ABSTRACT

A sensing system for detecting a full condition within a developer waste bottle, said sensing system including a sensor assembly mounted exterior to the developer waste bottle, said sensor assembly being responsive to magnetic material in said developer waste bottle when the magnetic material in said developer waste bottle reaches a predetermined level.

3 Claims, 2 Drawing Sheets

DEVELOPER LEVEL DETECTION SYSTEM

BACKGROUND OF THE INVENTION

This invention relates to electrophotographic copiers and duplicators and, more particularly to a detection system for warning a machine operator of impending over filling of a developer waste bottle.

In the process of electrostatographic printing, an electrostatic charge pattern or latent image corresponding to an original document to be reproduced is recorded on an insulating medium. A viewable record is produced by developing the latent image with particles of granulated material to form a powder image thereof. Thereafter, the visible powder image is fused to the insulating medium, or transferred to a suitable support material and fused thereto. Development of the latent image is achieved by bringing a developer mix into contact therewith. Typical developer mixes generally comprise dyed or colored thermoplastic particles of granulated material known in the art as toner particles, which are mixed with carrier granules, such as ferromagnetic granules. When appropriate, toner particles are mixed with carrier granules and the toner particles are charged triboelectrically to the correct polarity. As the developer mix is brought into contact with the electrostatic latent image, the toner particles adhere thereto. However, as toner particles are depleted from the developer mix, additional toner particles (simply "toner" hereafter) must be supplied. In this way, the concentration of toner in the developer mix is maintained substantially constant.

In developer that employ "trickle" development, a small amount of fresh carrier is included with the supply of toner which is dispensed by a dispensing apparatus into the developer subsystem. Generally, this system employs a developer overflow system in the developer subsystem which maintains the sump at a constant volume of developer. As new toner (and therefore new carrier) is constantly input into the developer subsystem, an equal amount of developer flows out through the overflow system via a hose into a waste bottle. It is desirable to know when this bottle is full so that it can be replaced with a fresh, empty bottle. If the machine is operated with a bottle that has reached its maximum capacity, the waste developer can "back up" into the developer housing and damage it.

Typically an optical sensor is used for full bottle detection, however toner contamination on the sensor or view window can trigger false readings. Hence, an alternate technique for sensing the amount of waste developer in the bottle is required. One alternative that has been used involves counting the number of copies since the bottle was last installed. This approach is not only indirect, but also inaccurate due to a wide variation in the amount of waste developer generated per copy. The inaccuracy correspondingly causes frequent bottle replacements and higher service costs. It has been found that in sensing system where the sensor is placed within the developer material, reliability and life expectancy of the sensor is at risk.

BRIEF SUMMARY OF THE INVENTION

The present invention is directed to a developer level sensing and indicator system which is relatively simple to install and to operate. There is provided a sensing system for detecting a full condition within a developer waste bottle, said sensing system including a sensor assembly mounted exterior to the developer waste bottle, said sensor assembly being responsive to the ferrous carrier in said developer waste bottle when the magnetic material in said developer waste bottle reaches a predetermined level.

Other features of the present invention will become apparent as the following description proceeds and upon reference to the drawings.

DETAILED DESCRIPTION OF THE PREFERRED EMBODIMENT OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
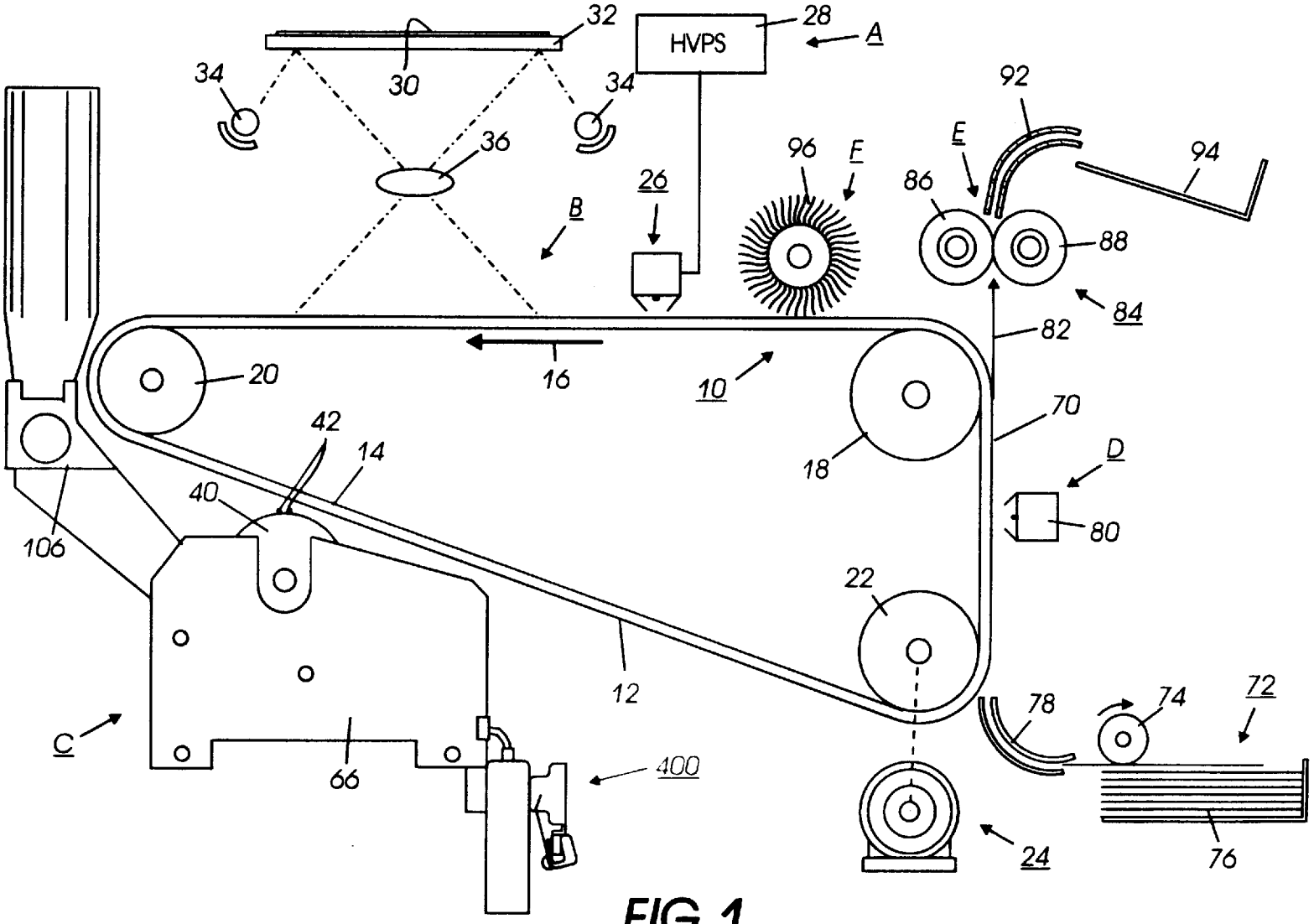
FIG. 1 is a schematic elevational view of an illustrative electrophotographic printing machine incorporating a developer unit having the features of the present invention therein.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from selenium alloy. Conductive substrate 14 is made preferably from an aluminum alloy that is electrically grounded. One skilled in the art will appreciate that any suitable photoconductive belt may be used. Belt 10 moves in the direction of arrow 16 to advance successive portions of photoconductive surface 12 sequentially through the various processing stations disposed of throughout the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 that corresponds to the informational areas contained within original document 30.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Preferably, developer unit 38 includes donor roll 40 and electrode wires 42. Electrode wires 42 are electrically biased relative to donor roll 40 to detach toner therefrom so as to form a toner powder cloud in the gap between the donor roll and the photoconductive surface. The latent image attracts toner particles from the toner powder cloud forming a toner powder image thereon. Donor roll 40 is mounted, at least partially, in the chamber of developer housing 66. The chamber in developer housing 66 stores a supply of developer material. In one embodiment the developer material is a single component development material of toner particles, whereas in another the developer material includes at least toner and carrier. In either case, the waste material must be capable of attracting a magnet.

With continued reference to FIG.1, after the electrostatic latent image is developed, belt 10 advances the toner powder image to transfer station D. A copy sheet 70 is advanced to transfer station D by sheet feeding apparatus 72. Preferably, sheet feeding apparatus 72 includes a feed roll 74 contacting the uppermost sheet of stack 76 into chute 78. Chute 78 directs the advancing sheet of support material into contact with photoconductive surface 12 of belt 10 in a timed sequence so that the toner powder image developed thereon contacts the advancing sheet at transfer station D. Transfer station D includes a corona generating device 80 which sprays ions onto the back side of sheet 70. This attracts the toner powder image from photoconductive surface 12 to sheet 70. After transfer, sheet 70 continues to move in the direction of arrow 82 onto a conveyor (not shown) that advances sheet 70 to fusing station E.

Fusing station E includes a fuser assembly, indicated generally by the reference numeral 84, which permanently affixes the transferred powder image to sheet 70. Fuser assembly 84 includes a heated fuser roller 86 and a back-up roller 88. Sheet 70 passes between fuser roller 86 and back-up roller 88 with the toner powder image contacting fuser roller 86. In this manner, the toner powder image is permanently affixed to sheet 70. After fusing, sheet 70 advances through chute 92 to catch tray 94 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 96 in contact with photoconductive surface 12. The particles are cleaned from photoconductive surface 12 by the rotation of brush 96 in contact therewith. Subsequent to cleaning, a discharge lamp (not shown) floods photoconductive surface 12 with light to dissipate any residual electrostatic charge remaining thereon prior to the charging thereof for the next successive imaging cycle.

As successive electrostatic latent images are developed, the toner particles within the developer material are depleted. In a "trickle" system, toner and carrier is received from a toner dispenser indicated generally by reference numeral 110. The supply of toner is maintained in container 112 and is introduced to development sump 114 via auger 116 which is driven at a constant rate whenever motor 118 is energized by toner control system 120, as described in U.S. Pat. No. 5,081,491. As new toner and carrier with carrier enters sump 114, toner and carrier exits through overflow exit 300 and moves to waste developer bottle 400 via hose 310.

Figure 2:
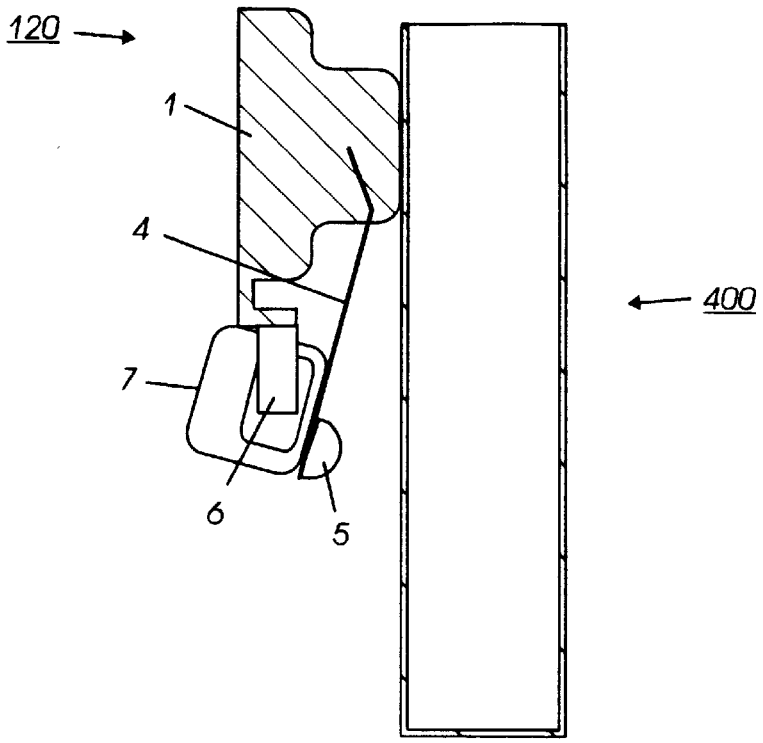
FIGS. 2 and 3 are a schematic elevational view sensor of the present invention.
Figure 3:
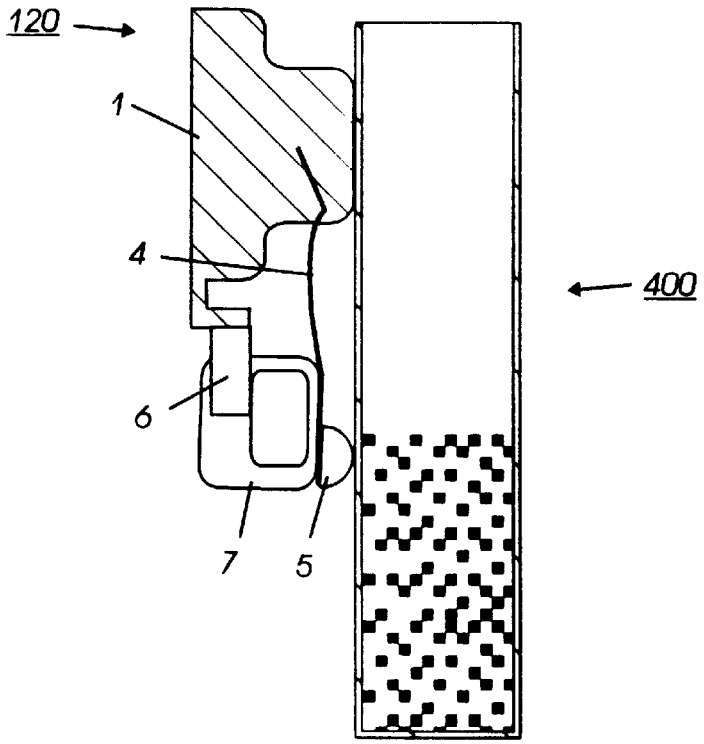

Referring to FIGS. 2 and 3, sensor assembly 120 is mounted adjacent to waste bottle 400. Sensor assembly 120 consist of leaf spring 4 having a magnetic pad 5 attached thereto and optical sensor 6. Member 1 keeps optical sensor in a fixed position. In operation magnetic pad 5 moves towards wastes bottle 400 due to the magnetic attraction between the rising carrier and toner in the bottle 400 and magnetic Pad. An indicating "flag" 7 on pad 5 moves in an outward direction which is detected by optical sensor 6 indicating a developer waste bottle full condition present signal to the sensor, as shown in FIG. 3. The signal can be sent to an user interface to indicate to the operator to replace the developer bottle and/or shut down the machine.

Advantageous features of the present invention is as follows: Optical sensor and sensing indicator "flag" is external to the waste bottle, and the toner and carrier material to be at level "A" on bottle 400 is needed to activate the indicator spring.

It is, therefore, apparent that there has been provided in accordance with the present invention that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. In a sensing system for detecting a full toner condition within a developer waste bottle, said sensing system comprising:

a sensor assembly mounted exterior to the developer waste bottle, said sensor being responsive to magnetic material in said developer bottle when the magnetic material in said toner waste bottle reaches a predetermined level, said sensor assembly comprises a leaf spring;

a magnetic pad attached at one end of said leaf spring, said magnetic pad in moveable toward a wall of said developer waste bottle when magnetic material in said developer waste bottle reaches said predetermine level; and a sensor for detecting the movement of said pad.

2. The system according to claim 1, further comprising circuitry responsive to said sensor for generating a feed back signal indicative of a "full bottle" condition within said developer waste bottle.

3. In a sensing system for detecting a full toner condition within a developer waste bottle, said sensing system comprising:

a sensor assembly mounted exterior to the developer waste bottle, said sensor being responsive to magnetic material in said developer bottle when the magnetic material in said toner waste bottle reaches a predetermined level, said sensor assembly includes a member, a magnetic pad attached at one end of said member, said magnetic pad in moveable toward a wall of said developer waste bottle when magnetic material in said developer waste bottle reaches said predetermine level, and a sensor for detecting the movement of said pad.

* * * * *